US010269512B2

(12) United States Patent
Andaluz Sorli

(10) Patent No.: US 10,269,512 B2
(45) Date of Patent: Apr. 23, 2019

(54) METHOD AND DEVICE FOR CUTTING OFF AN ELECTRIC CURRENT WITH DYNAMIC MAGNETIC BLOW-OUT

(71) Applicant: GORLAN TEAM, S.L.U., Amorebieta (ES)

(72) Inventor: Jose Oscar Andaluz Sorli, Zaragoza (ES)

(73) Assignee: GORLAN TEAM S.L.U., Amorebieta Vizcaya (ES)

( * ) Notice: Subject to any disclaimer, the term of this patent is extended or adjusted under 35 U.S.C. 154(b) by 0 days.

(21) Appl. No.: 15/599,100

(22) Filed: May 18, 2017

(65) Prior Publication Data

US 2017/0358402 A1 Dec. 14, 2017

(30) Foreign Application Priority Data

Jun. 10, 2016 (EP) ..... 16382267

(51) Int. Cl.

| | |
|---|---|
| ***H01H 9/44*** | (2006.01) |
| ***H01H 33/59*** | (2006.01) |
| ***H01H 1/36*** | (2006.01) |
| ***H01H 1/44*** | (2006.01) |

(52) U.S. Cl.

CPC ..... *H01H 9/443* (2013.01); *H01H 33/596* (2013.01); *H01H 1/365* (2013.01); *H01H 1/44* (2013.01)

(58) Field of Classification Search

CPC ..... H01H 9/443; H01H 9/40; H01H 9/02; H01H 9/446; H01H 1/36; H01H 33/596; H01H 1/44; H01H 33/53

USPC ..... 218/26, 27, 23, 22; 335/201

See application file for complete search history.

(56) References Cited

U.S. PATENT DOCUMENTS

| | | | | |
|---|---|---|---|---|
| 4,367,448 A * | 1/1983 | Nishizako | ..... | H01H 9/443 335/201 |
| 6,103,986 A * | 8/2000 | Asakawa | ..... | H01H 77/108 218/22 |
| 8,575,508 B2 * | 11/2013 | Kashiwagi | ..... | H01H 31/003 218/23 |

(Continued)

FOREIGN PATENT DOCUMENTS

| | | |
|---|---|---|
| EP | 2667394 A1 | 11/2013 |
| EP | 2866244 A1 | 4/2015 |

(Continued)

*Primary Examiner* — Edwin A. Leon
*Assistant Examiner* — William Bolton
(74) *Attorney, Agent, or Firm* — Hayes Soloway PC

(57) ABSTRACT

The invention relates to a method and a device for cutting off electric current. The device comprises at least one fixed contact and at least one moving contact that can move between a closed position and an open position, and at least one permanent magnet mounted together with the moving contact, such that the permanent magnet and the moving contact are able to move at the same time. The magnetic field of the magnet interferes with the area where the arc occurs and moves with the moving contact along its path, so with a small number of magnets, arc quenching capacity increases. The method of the invention comprises moving a permanent magnet through the area where an electrical arc occurs between a moving contact and a fixed contact, such that the generated magnetic field runs through at least part of the area where the arc occurs.

8 Claims, 7 Drawing Sheets

(56) References Cited

U.S. PATENT DOCUMENTS

| | | | | |
|---|---|---|---|---|
| 2011/0042354 | A1* | 2/2011 | Blalock | H01H 33/182 218/29 |
| 2013/0105444 | A1 | 5/2013 | Prohaska et al. | |
| 2013/0222088 | A1 | 8/2013 | Kashiwagi et al. | |
| 2014/0284310 | A1* | 9/2014 | Gerving | H01H 9/36 218/26 |
| 2014/0346144 | A1 | 11/2014 | Coquil et al. | |

FOREIGN PATENT DOCUMENTS

| | | | | |
|---|---|---|---|---|
| ES | 1116655 | | 7/2014 | |
| GB | 2058463 A | * | 4/1991 | H01H 33/18 |

* cited by examiner

METHOD AND DEVICE FOR CUTTING OFF AN ELECTRIC CURRENT WITH DYNAMIC MAGNETIC BLOW-OUT

OBJECT OF THE INVENTION

The present invention generally relates to electrical switches and/or disconnectors, particularly suitable for quenching an electrical arc occurring between contacts in the opening and closing operations.

More specifically, the invention relates to a method and a device for cutting off electric current, using magnetic blow-out for quenching the electrical arc, the purpose of which is to increase the arc quenching capacity, and at the same time reduce manufacturing costs.

The method and device of the invention can be applied to any type of breaker, switch or disconnector, either with moving contacts with linear, rotational or helicoidal movement, with a one-pole or multi-pole configuration.

BACKGROUND OF THE INVENTION

The mechanical switches are devices used to connect and disconnect a load from an electric power source and are based on applying an external force moving several moving contacts with respect to other fixed contacts, such that when the circuit is going to close, the moving contacts come into contact with the fixed contacts, electrically connecting a load and an energy source, and thereby allowing current circulation.

The opposite process corresponds to the movement of the moving contacts with respect to the fixed contacts, such that these moving contacts move away from the fixed contacts, making the circuit open and therefore interrupting current circulation.

Switches with a different type of movement of its moving parts, either with linear, rotational or helicoidal movement, are known. European patent application EP2,667,394A1 describes an example of a switch with linear movement of the moving contacts. Spanish utility model ES1116655U describes a rotating switch, and European patent application EP2,866,244A1 describes a helicoidal switch.

During transitory opening and closing operations, electrical arcs or voltaic arcs are formed in the contact areas between the moving and fixed contacts. Electrical arcs are known to cause many problems because the heat generated during the occurrence of an electrical arc is highly destructive. Some of these problems are: deterioration of the materials of the switch, malfunctions and/or complete or partial destruction of electrical installations, including injuries to people caused by burns or injuries of another type.

The problems in quenching electrical arcs are particularly notable in direct current interruption, because unlike alternating current, there is no zero-crossing, such that electrical arcs must be eliminated as quickly as possible by means of deionizing the medium and increasing dielectric resistance.

One of the techniques known for increasing efficacy in quenching an electrical arc specifically in the case of DC switches, is the use of a blow-out with a magnetic field generated by permanent magnets.

The technique currently used to produce the magnetic blow-out is to place several permanent magnets in a fixed position such that they drive the electrical arc as quickly as possible to a quenching area, such as deionizing chambers, elongation partitions, etc.

Since the permanent magnets are placed in a fixed position, the generated magnetic field always remains stationary, so in order for the magnetic field to reach the entire area in which the arc extends, several magnets must be used or polar expansions must be added to increase the surface of the magnetic field depending on the length of the path between fixed and moving contacts.

Spanish utility model ES1116655U shows an example of these magnetic blow-out techniques using several permanent magnets installed in a fixed position of the switch.

Since several magnets and polar expanders are required, these conventional techniques involve an increase in the material used, as well as an increase in the volume of the switch for housing the magnets near the area where the electrical arc occurs.

Generally, in the known techniques, the magnets are placed in an intermediate position of the maximum path between the fixed contact and the moving contact, so the magnetic field interferes with the electrical arc once the arc has already been generated, which limits the arc quenching capacity.

DESCRIPTION OF THE INVENTION

The invention is defined in the attached independent method and device claims.

One aspect of the invention relates to a breaker, switching and/or disconnector device for cutting off an electric current, conventionally comprising at least one fixed contact and at least one moving contact that can move reciprocally between a closed position in which it establishes electrical continuity and comes into contact with the fixed contact, and an open position in which it is separated from the fixed contact and prevents current circulation. The device also comprises one or more permanent magnets, placed so that their magnetic field passes through (or interferes with) an area of the device in which the occurrence of an electrical arc between the fixed contact and the moving contact in opening and closing operations is expected, such that the magnetic field causes the elongation of the arc and thereby helps to quench it.

The device of the invention is characterized in that the permanent magnet or magnets are mounted together with the moving contact, such that the moving contact and the permanent magnet or magnets move at the same time. The permanent magnet or magnets are mounted in the moving contact by means of a part made of an isolating material, such that the magnets are not in contact with the fixed contacts. That part made of an isolating material can consist of a support specifically designed for mounting the magnets with the fixed contact, or can alternatively consist of the actuator of the breaker, for example the slide or rotor of the breaker.

One technical effect that is obtained with this arrangement of elements is that it achieves, in a very simple manner, the magnetic field generated by a magnet being dynamic, i.e., the magnetic field moves at the same time as the moving contact in which they are installed. It can therefore be said that the magnetic field chases the electrical arc, so with a single magnet, instead of several as occurs in the state of the art, a magnetic field is applied in the very instant the arc occurs, and throughout the entire space in which the arc extends.

One of the main advantages of the invention is that the number of magnets required in each cut-off area is reduced, and therefore the material required for applying the field to the entire area where the arc occurs is reduced.

Furthermore, since the permanent magnet is mounted with the moving contact as proposed by the invention, it is possible to place the magnet very close to the space between the fixed contact and the moving contact in the electrically closed position. An additional technical effect and advantage associated with said arrangement of the permanent magnet is that the magnetic field is applied in the area where the arc occurs even before the arc is generated, so in the very instant in which the arc starts to occur in an opening operation, the arc runs into the magnetic field which complicates the flow thereof. The arc quenching capacity is thereby enormously increased, and the quenching time with respect to the techniques known today, in which the magnetic field only interferes with the arc in an instant after it is generated, is reduced.

The invention can be applied to any type of breakers or switches having one or several poles, whether they are breakers with moving contacts having linear, radial or helicoidal movement.

Another aspect of the invention relates to a method for cutting off an electric current, preferably by means of the breaker described above. The method comprises moving a moving contact with respect to a fixed contact to interrupt electric current circulation, and to apply a magnetic field by means of a permanent magnet such that it interferes, i.e., passes through an area where an electrical arc occurs between the fixed contact and the moving contact when the fixed contact and the moving contact move relative to one another, and such that the magnetic field complicates the creation of an arc and helps quench it.

The method is characterized in that it comprises moving the permanent magnet in the transitory opening and closing phases of the breaker, such that the generated magnetic field runs throughout the area where the arc occurs from its point of origin.

In a preferred embodiment of the invention, the permanent magnet and the moving contact move linearly with respect to a longitudinal axis. In another preferred embodiment, the permanent magnet and the moving contact move rotationally on one and the same plane with respect to an axial axis, and in another preferred embodiment they move in a helicoidal manner with respect to an axial axis.

The same technical effects and advantages discussed above with respect to the switching device are also obtained with the method of the invention.

Said area where the arc occurs can be defined as the space that is formed between the fixed contact and the moving contact in which electrical arcs are expected to be formed, including the electrically closed position and subsequently the space between both as these two contacts move relative to one another, whether in the opening or closing operation of the breaker device.

DESCRIPTION OF THE DRAWINGS

Several preferred embodiments of the invention are described below in reference to the attached drawings, where:

FIG. 1 shows several perspective views of an embodiment of a linear breaker according to the invention, where FIG. 1A corresponds to a one-pole breaker; In FIGS. 1A, 1B, and 1C, the arrows indicate the linear movement of the moving contacts. In FIGS. 1D and 1E, the multiple arrows starting from the magnet represent the magnetic field (B). The movement of the magnetic field "B" along with the magnet can be seen in FIGS. 1D and 1E.

FIG. 3 shows several perspective views of an embodiment of a rotating breaker according to the invention, where In FIG. 3A, the arrow around the "X" axis indicates the rotational movement of the rotor. In FIGS. 3C and 3D, the multiple arrows starting from the magnet represent the magnetic field (B).

PREFERRED EMBODIMENT OF THE INVENTION

Figure 1A:
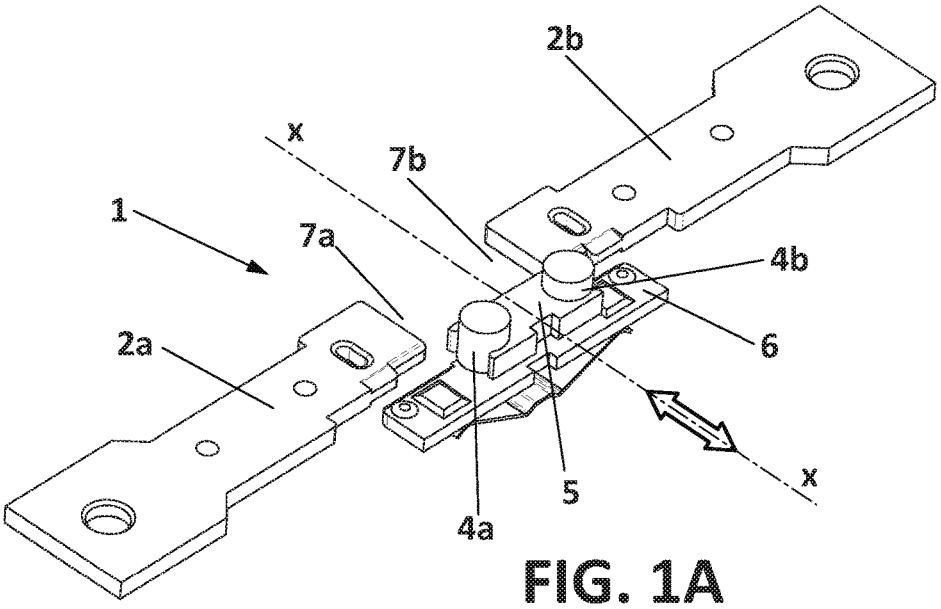

FIG. 1A shows an embodiment of a one-pole linear breaker (1) according to the invention, formed by two facing fixed contacts (2*a*, 2*b*) and one moving contact (6) arranged between the fixed contacts (2*a*, 2*b*) that can move linearly and reciprocally along an "X" axis. The moving contact (6) is the one that can move between a closed position in which it establishes electrical continuity with the fixed contacts (2*a*, 2*b*), and an open position such as the one shown in FIG. 1A, in which it prevents current circulation.

The breaker (1) has two cylindrical permanent magnets (4*a*, 4*b*), which are mounted together with the moving contact (6) on one of its faces by means of a support (5) made of an isolating material. This support (5) is clamp-shaped at the ends thereof, such that the magnets (4*a*, 4*b*) are retained by elastic pressure at said ends, as depicted with more detail in FIG. 2.

Figure 2A:
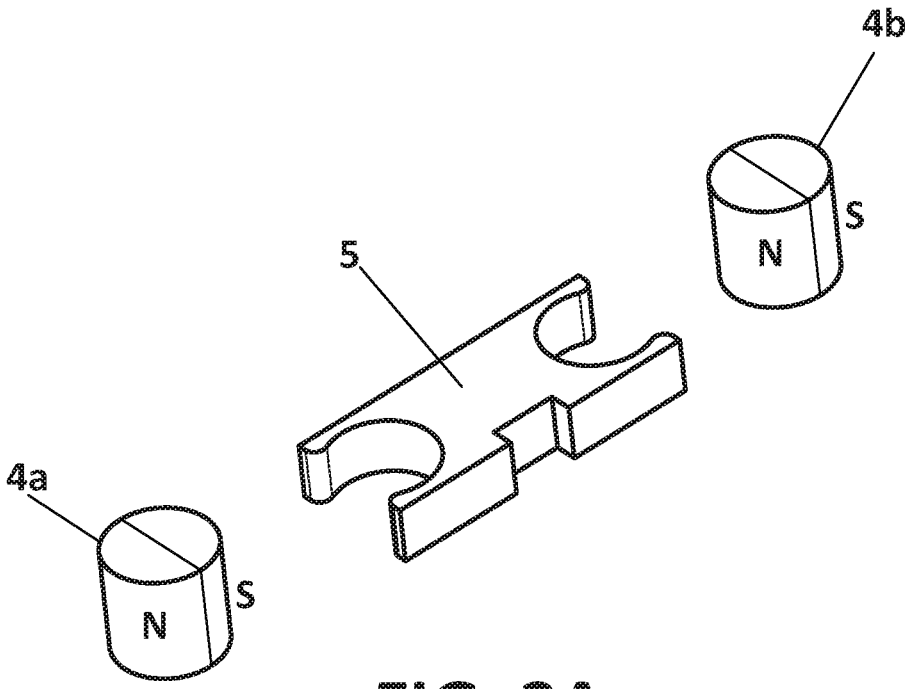
In FIG. 2A, they are separated from the isolating support, and in FIG. 2B they are coupled in the support.
Figure 2B:
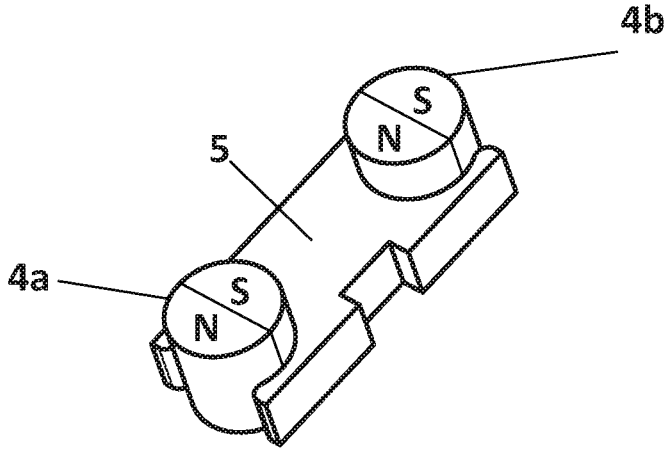
FIG. 2 shows two perspective views of the set of permanent magnets.
Figure 3A:
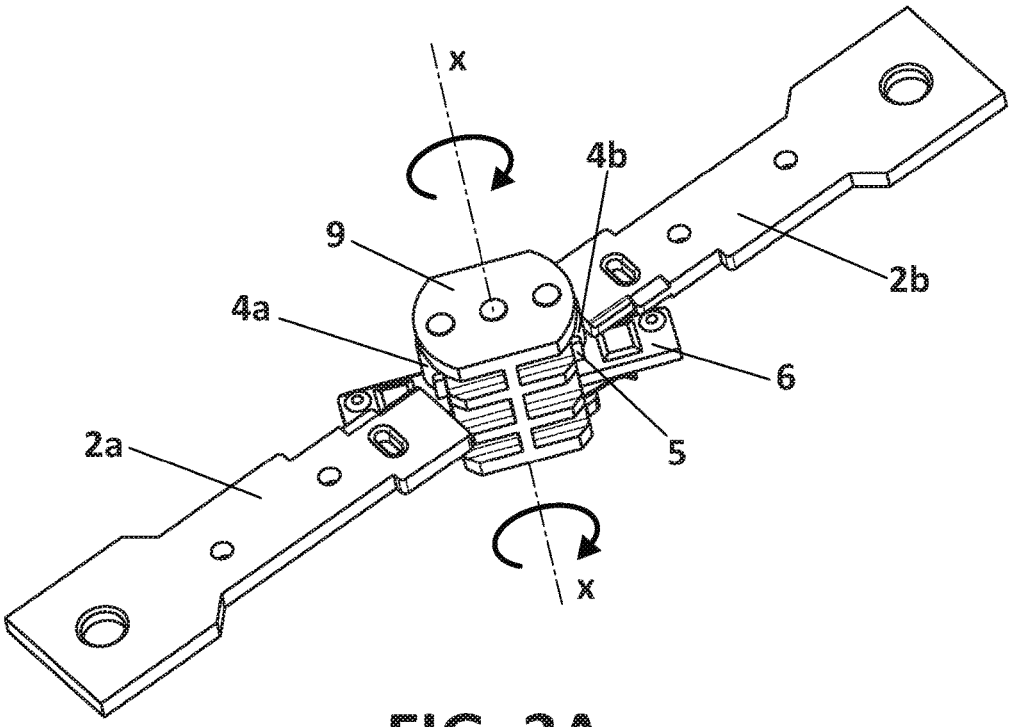
FIG. 3A shows the breaker with the rotor.
Figure 3B:
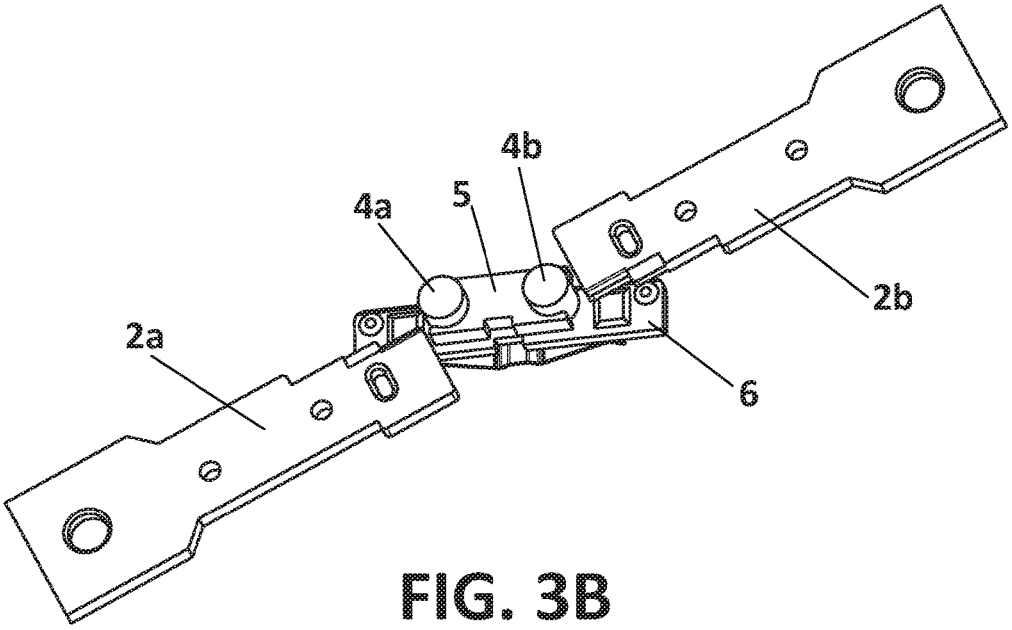
FIG. 3B is the same as the previous depiction but without a rotor so that the position of the magnets can be seen.
Figure 3C:
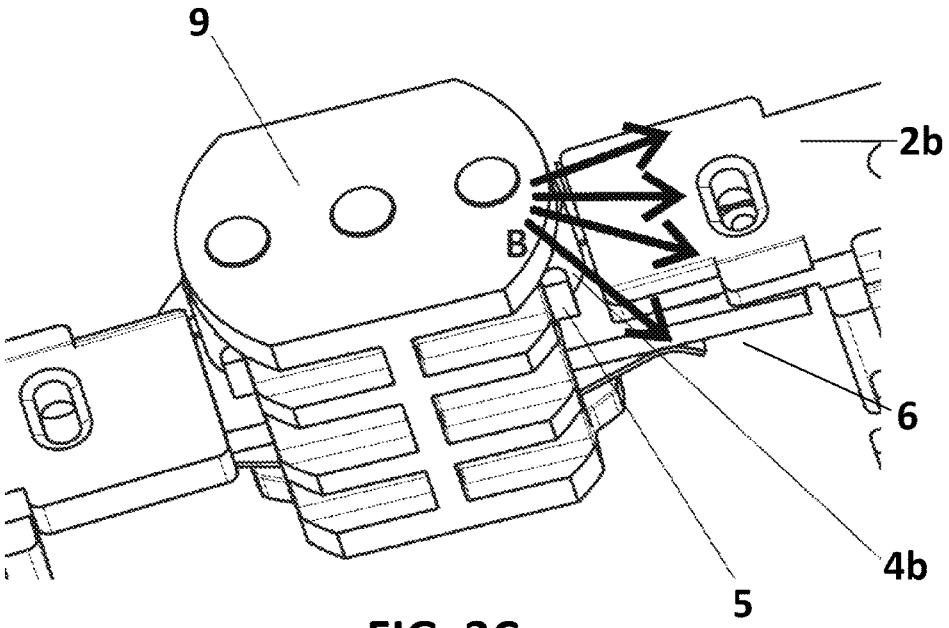
FIG. 3C is an enlarged detail in the closed position of the breaker.
Figure 3D:
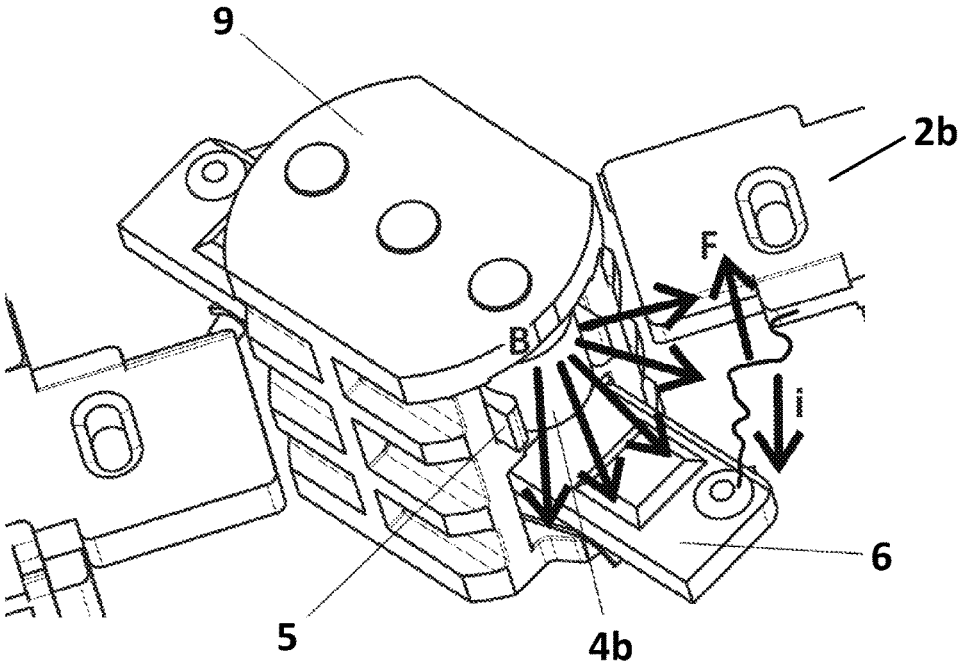
FIG. 3D is an enlarged detail of the dynamic blow-out process by means of a magnetic field.

The permanent magnets (4*a*, 4*b*) have diametric polarization, i.e., a semi-cylinder of the magnet has one polarity, and the other semi-cylinder has the opposite polarity, as shown in FIG. 2. The position of the magnets in reference to their polarity is chosen depending on the current circulation direction in the case of direct current, and on the direction towards which the arc is to be elongated.

The support (5) is fixed on the moving contact (6), such that the magnetic field generated by each of the magnets (4*a*, 4*b*) interferes respectively with each area where an electrical arc occurs (7*a*, 7*b*) between each of the fixed contacts and the moving contact. Both the moving contact (6) and the fixed contacts (2*a*, 2*b*) are metal flats with a generally rectangular shape with upper and lower faces. As seen in the drawing, the permanent magnets (4*a*, 4*b*) are arranged on the upper face of the moving contact (6) which is also the face intended for coming into contact with the lower face of the fixed contacts (2*a*, 2*b*).

Figure 1B:
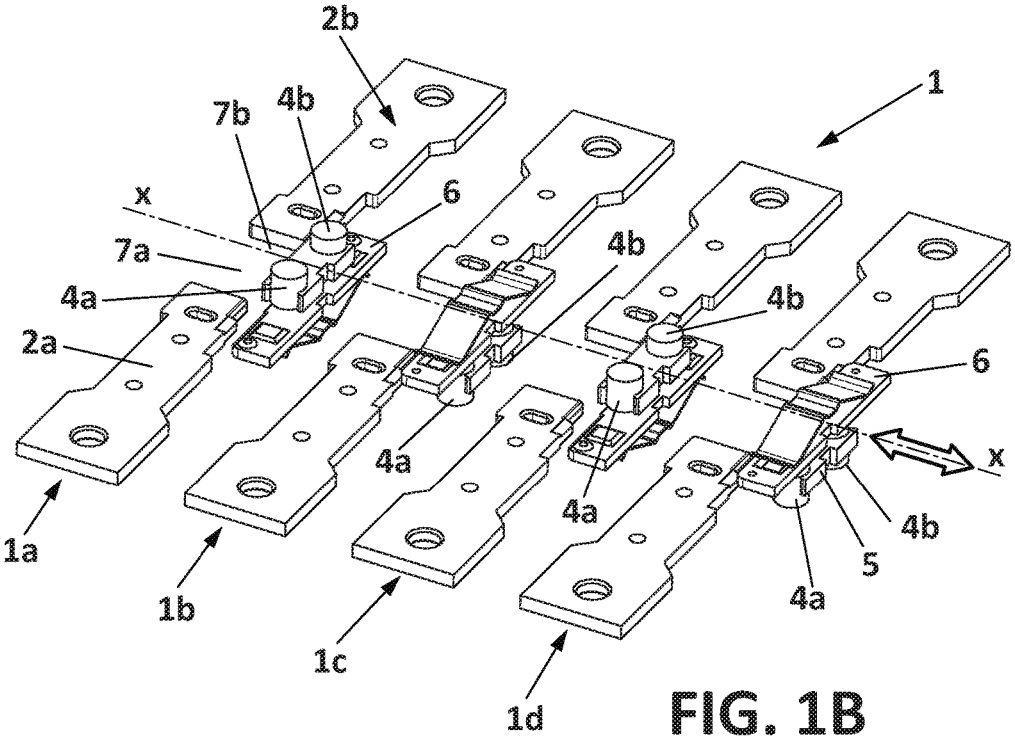
FIG. 1B shows the breaker with several poles.

In the embodiment of FIG. 1B, the breaker (1) is multi-pole, in which each of its poles (1*a*, 1*b*, 1*c*, 1*d*) is an individual breaker like the one depicted and described above in relation to FIG. 1A. A particularity of this embodiment is that the relative position between the moving contact and the fixed contacts of each pole alternate from one pole to the adjacent poles. It can be seen in this embodiment that, as in the case of the poles (1*a*, 1*c*), the upper face of the moving contacts (6) is the one that has the magnets and is intended for coming into contact with the lower face of the corresponding fixed contacts. In the case of the poles (1*b*, 1*d*), the position of the magnets and moving contacts is the opposite with respect to the poles (1*a*, 1*c*).

Figure 1C:
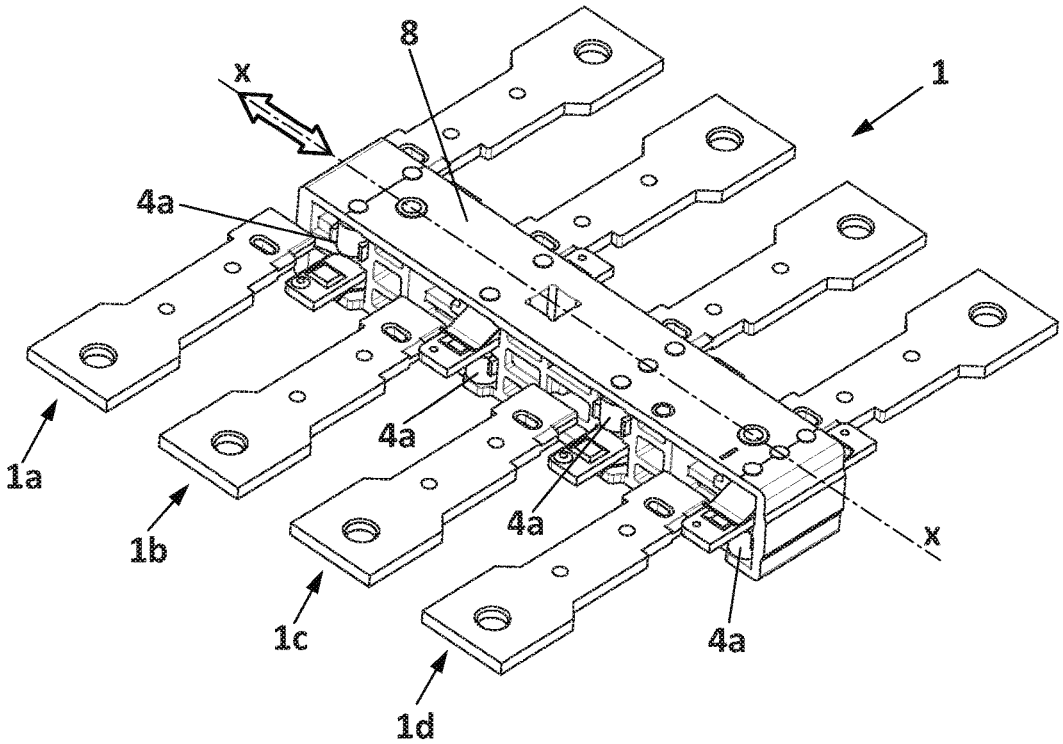
FIG. 1C is a depiction similar to that of FIG. 1B but incorporating a slide.

As shown in FIG. 1C, the breaker (1) has an actuator, in this case a slide (8) having reciprocal linear movement along the "X" axis. The moving contacts (2*a*, 2*b*) with their respective magnets (4*a*, 4*b*) are mounted in the slide (8), such that the magnets are housed inside the slide (8) but are visible from outside the slide (8) which has side windows for that purpose.

Figure 1D:
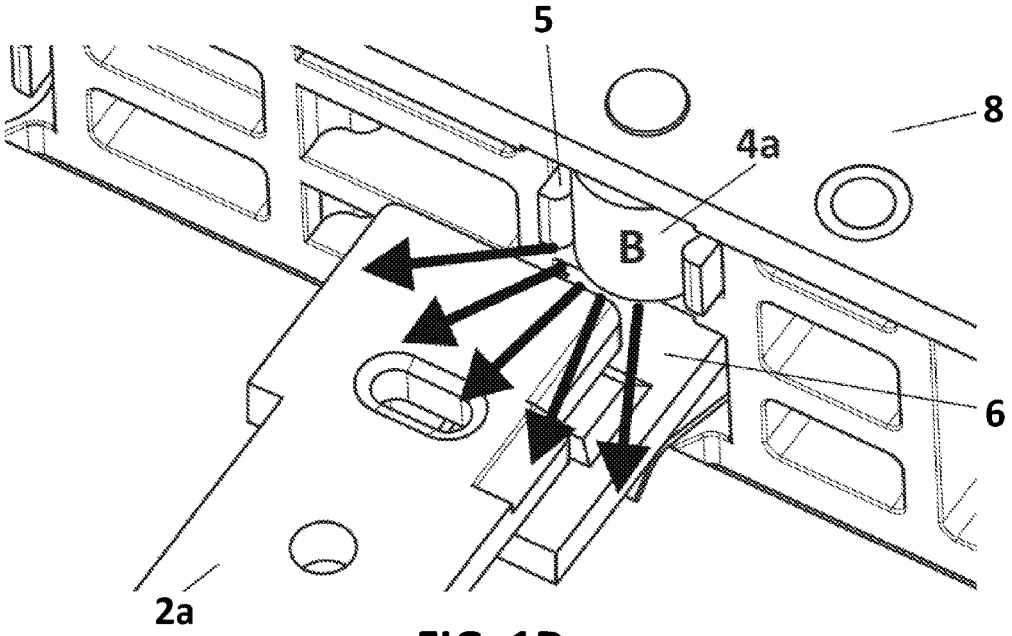
FIG. 1D is an enlarged detail in the closed position of the breaker.
Figure 5:
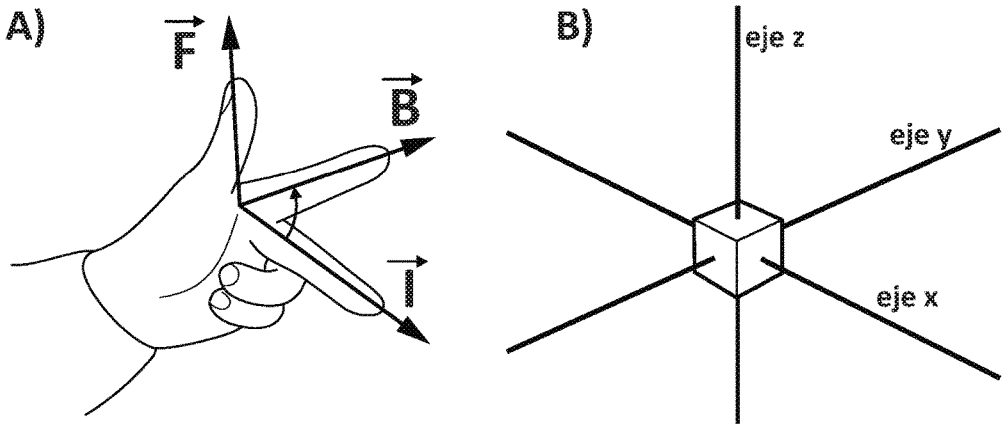
FIG. 5 PRIOR ART
FIG. 5 depicts common general knowledge about the behavior of an electrical arc in a magnetic field according to the Lorentz force law and the left-hand rule.

FIG. 1D depicts the magnetic blow-out process which is obtained with the arrangement of magnets of this embodiment. It is known that the behavior of an electrical arc in a magnetic field obeys the Lorentz force law and forms a three-vector orthogonal system (FIG. 5B). As a practical method for determining the direction of the force, the left-hand rule is used (FIG. 5A), where: "B" is the direction of the magnetic field generated by a magnet, "I" is the direction of the electric current, and "F" is force driving the electrical arc due to the effect of the magnetic field. If the direction of B or I changes, the direction of the resulting movement F changes on the same Z axis.

Figure 1E:
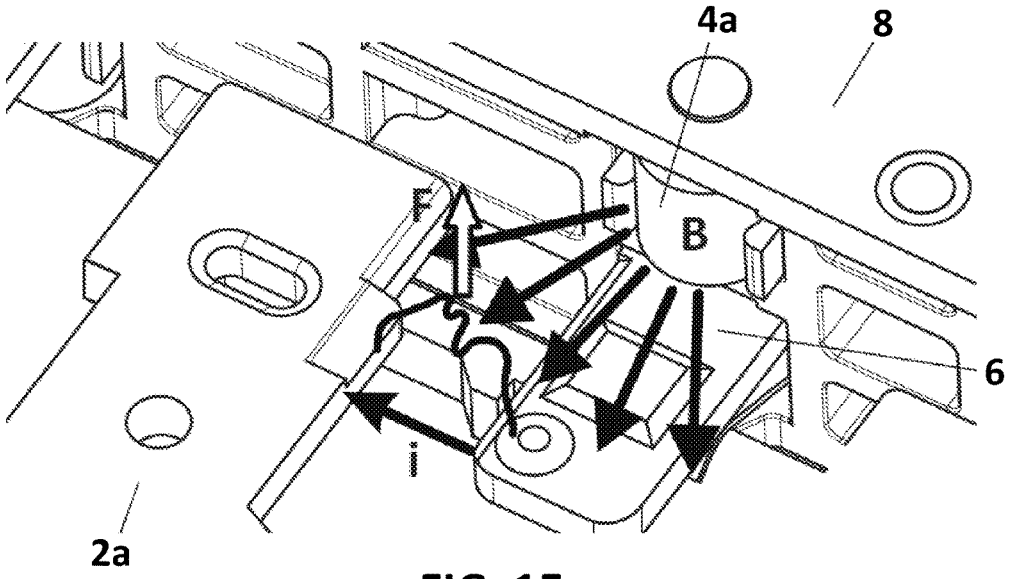
FIG. 1E is an enlarged detail of the dynamic blow-out process by means of a magnetic field in an open position of the moving contact.

FIG. 1E shows a permanent magnet (4*a*) placed to generate a magnetic field (B) which interferes with the electrical arc occurring between the fixed contact (2*a*) and the moving contact (6), such that taking into account the direction of the field (B) and the current (I), a force (F) is generated in the direction orthogonal to a plane on which the moving contacts (2*a*, 2*b*) move, so that force (F) elongates the arc towards the upper part of the figure until it breaks. Since the magnet (4*a*) moves at the same time as the moving contact (6) and the slide (8), the magnetic field (B) also moves along with the moving contact (6).

The embodiment of FIG. 3 consists of a rotating breaker in which instead of being a slide, the actuator is a rotor (9) made of an isolating material that can rotate reciprocally on one and the same plane around its "X" axis. The moving contact (6) and the permanent magnets (4*a*, 4*b*), are mounted in the rotor (9) and therefore move together with the rotor (9) between the opened and closed positions of the breaker.

Figure 4:
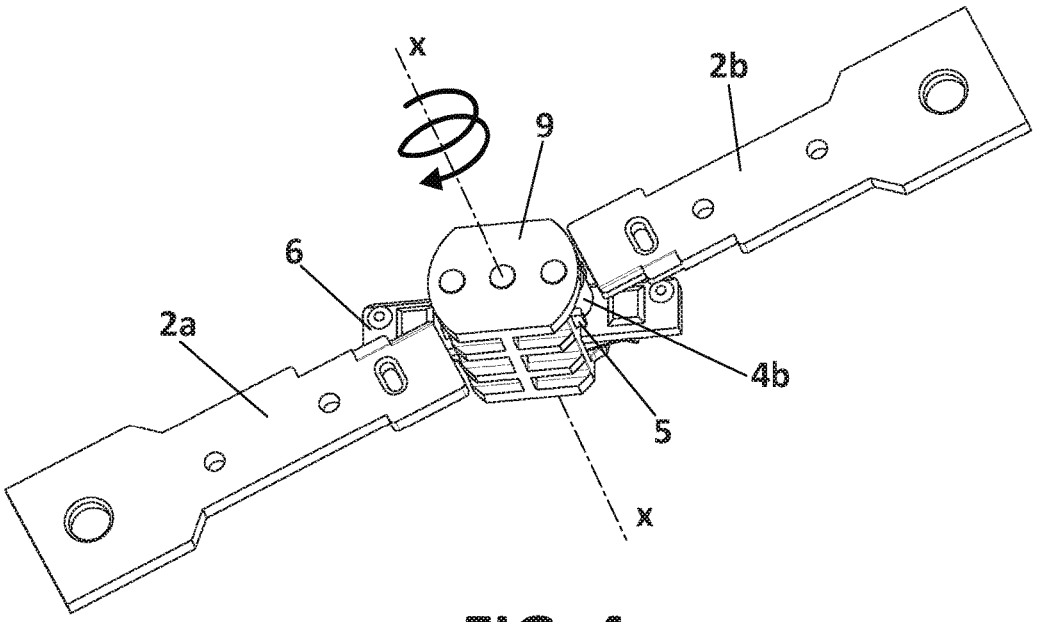
FIG. 4 shows a perspective view of another embodiment similar to that of FIG. 3, but in which the rotor moves in a helicoidal manner.

The embodiment of FIG. 4 is similar to the embodiment of FIG. 3, but the rotor (9) moves in a helicoidal manner with respect to the axial axis "X" of the rotor, also reciprocally between the opened and closed positions of the breaker.

The blow-out process of the embodiments of FIGS. 3 and 4 is similar to that of FIG. 1, but the magnets move rotationally and helicoidally, respectively.

As an alternative to the use of a support (5) for mounting the magnets (4*a*, 4*b*) with the moving contact (6), the magnets can be fixed to the actuator, i.e., to the slide (8) in the embodiment of FIG. 1 or to the rotor (9) in the embodiments of FIGS. 3 and 4, such that the magnets (4*a*, 4*b*) are mounted together with the moving contact (6) through the slide or of the rotor.

The method of the invention is depicted, for example, in FIGS. 1D, 1E, 3C and 3D. It can particularly be seen in FIGS. 1D and 3C how both in the device and in the method of the invention a magnetic field (B) is being applied to the space between the fixed contacts and the moving contact at all times, even before starting the process of opening the breaker by starting to move the moving contact (6), so in the very instant the electrical arc starts to occur there is already a magnetic field applied in that area making the formation thereof complicated, thereby increasing the breaking capacity of the breaker and reducing the quenching time.

It is also seen in FIGS. 1D, 1E, 3C, and 3D how at the same time the moving contact (6) moves with respect to the fixed contacts (2*a*, 2*b*) to open the breaker and interrupt an electric current circulation, the magnet or permanent magnets (4*a*, 4*b*) mounted together with the moving contact (6) also move, so the generated magnetic field (B) also moves, performing the same movement as the fixed contacts, and running through the area where the arc occurs between the fixed contact and the moving contact to help in quenching the electrical arc.

The invention claimed is:

1. A device for cutting off an electric current comprising:

at least two fixed contacts and at least one moving contact arranged for coming into contact with the fixed contacts, wherein the at least one moving contact can move between a closed position in which the at least one moving contact establishes electrical continuity with the fixed contact and an open position in which the at least one moving contact prevents current circulation; and at least two permanent magnets placed to generate a magnetic field that interferes with an area where an electrical arc occurs between the at least two fixed contacts and the moving contact to help in quenching the electrical arc, characterized in that the two permanent magnets are mounted together with the moving contact, such that the at least two permanent magnets and the moving contact are able to move at a same time, and wherein the magnetic field of each of the two permanent magnets interferes respectively with the area where the electrical arc occurs between each of the two fixed contacts and the moving contact and wherein the magnets are cylindrical and have diametric polarization.

2. The device according to claim 1, where the two permanent magnets are positioned in the moving contact, such that in an electrically closed position, the permanent magnets are proximal to an end of each fixed contact and the magnetic field passes through a space between the fixed contact and the moving contact.

3. The device according to claim 1, further comprising a support made of an electrically isolating material fixed to the moving contact, and where the two permanent magnets are mounted in said support such that they are electrically isolated from the moving contact.

4. The device according to claim 3, where said support has two clamp-shaped ends, and where each of the magnets is housed in one of the ends of the support.

5. The device according to claim 1, further comprising a moving actuator made of an isolating material, where the at least one moving contact is mounted in the actuator, and where the magnets are housed at least partly inside the actuator.

6. The device according to claim 1, further comprising a moving actuator made of an isolating material, where the at least one moving contact is mounted in the actuator, and where the magnets are mounted in the actuator and housed at least partly inside the actuator.

7. The device according to claim 5, where the actuator is a linear slide that slides with respect to a longitudinal axis, or where the actuator is a rotor rotating on one and a same plane with respect to an axial axis, or where the actuator is a rotor that can move in a helicoidal manner with respect to an axial axis.

8. The device according claim 1, having two or more poles, where each pole is formed by a pair of fixed contacts, a moving contact and two permanent magnets.

* * * * *